United States Patent [19]

Wiese et al.

[11] Patent Number: 4,854,005

[45] Date of Patent: Aug. 8, 1989

[54] AUTOMATIC FLOOR SCRUBBING MACHINE WITH SQUEEGEE ASSEMBLY AND ADJUSTABLE WHEELS

[76] Inventors: Martin E. Wiese, 53070 Haddington, South Bend, Ind. 46635; Dexter K. Lehman, 23184 C.R. 26 East, Elkhart, Ind. 46517

[21] Appl. No.: 266,838

[22] Filed: Nov. 3, 1988

[51] Int. Cl.[4] ..... A47L 11/202

[52] U.S. Cl. ..... 15/320; 15/401

[58] Field of Search ..... 15/320, 401, 245

[56] References Cited

U.S. PATENT DOCUMENTS

| | | | |
|---|---|---|---|
| 3,065,490 | 11/1962 | Arones | 15/401 X |
| 3,290,716 | 12/1966 | Cain | 15/320 X |
| 3,496,591 | 2/1970 | Sheler | 15/401 X |
| 3,649,995 | 3/1972 | Ison | 15/320 |
| 4,006,506 | 2/1977 | Burgoon | 15/320 X |
| 4,158,901 | 6/1979 | Wulff et al. | 15/401 |
| 4,173,056 | 11/1979 | Geyer | 15/320 |

*Primary Examiner*—Chris K. Moore

*Attorney, Agent, or Firm*—Alfred E. Miller

[57] ABSTRACT

An automatic floor scrubbing machine provided with a mopping device in the form of a trailing squeegee having a pivotable squeegee bar with adjustable wheels. The adjustable wheels a spring biased toward the floor and are maintained at a certain level above the floor by means of a spring. The trailing squeegee is constrained to follow the movement of the scrubbing machine when it turns without drifting sideways.

4 Claims, 3 Drawing Sheets

AUTOMATIC FLOOR SCRUBBING MACHINE WITH SQUEEGEE ASSEMBLY AND ADJUSTABLE WHEELS

The present invention relates to a floor scrubbing machine provided with a trailing squeegee having a pivotable squeegee bar with adjustable wheels.

Automatic floor scrubbing machines are known having a cleaning solution tank and a dirty solution tank in the forward part thereof, a suitable motor to drive the machine, as well as a scrubbing unit constituting scrub brushes, and a squeegee assembly having a curved or arcuate squeegee mounted in the rear thereof. Such a device is shown and described in U.S. Pat. No. 4,006,506 to Burgoon.

The prior art machines of the type described above all have a drawback in that the squeegee assembly in an operating machine would often drift to one side when a turn was made on a smooth floor that was being cleaned by the machine. When this occured, water or other liquid floor cleaning substances being dispensed from the machine on the floor, would be left on the floor, thus requiring additional clean up.

It is therefore a principal feature of the present invention to provide a squeegee bar assembly that is pivoted to the main housing of an automatic floor scrubber and which is provided with a pair of wheels having sufficient pressure, which are adjustable, to ensure that the squeegee is forced to follow the turning movements of the machine without drifting laterally off to the side.

An object of the present invention is to provide a squeegee assembly mounted on a pivoting squeegee bar in an automatic floor scrubbing machine which follows the movements of the machine and is constrained to move forwardly with the movement of the machine and with restricted lateral movements so that any liquids deposited on the floor by the machine will be moved long by the squeegee assembly and not left as a remaining wet area on the floor.

Another feature of the present invention is to make provision for setting the height of the squeegee bar by means of an adjusting screw, which maintains the squeegee at the correct height from the floor level at all times.

Another feature of the present invention is to provide securing means for the squeegee assembly which can be easily and rapidly detached, when necessary. Furthermore, the unit is relatively simple in construction, but is rugged for long wear and functions efficiently and reliably for the purposes intended.

In order that the present invention will be more clearly understood, it will now be disclosed in greater detail with reference to the accompanying drawings in which:

FIG. 1 is a bottom plan view of the automatic floor scrubbing machine with a squeegee arrangement contructed in accordance with the teachings of the present invention.

FIG. 1*a* is a perspective view of the automatic floor scrubbing machine incorporating a squeegee assembly with adjustable wheels in accordance with the teachings of my invention.

FIG. is a side elevation view thereof.

Figure 6:
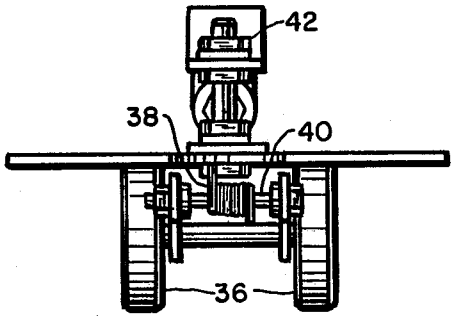

FIG. 6 is a front elevation view of the squeegee bar assembly.

Figure 7:
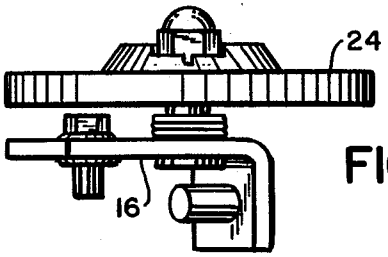
Figure 8:
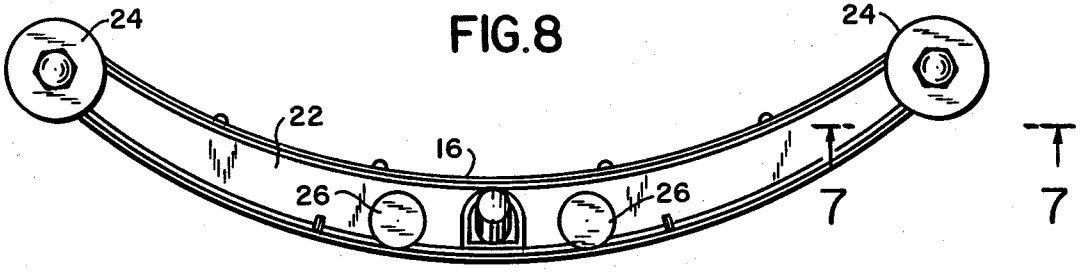

FIG. 7 is a view taken along the lines 7—7 of FIG. 8 and

FIG. 8 is a top plan view of the squeegee assembly.

DESCRIPTION OF THE PREFERRED EMBODIMENT

Figure 1:
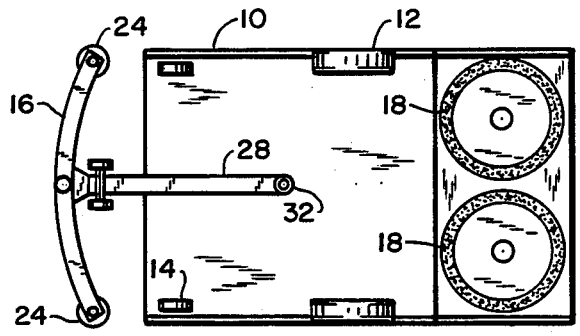

As seen in FIG. 1 an automatic floor scrubbing machine 10 is shown for cleaning and polishing of a floor.

The machine, as seen in FIG. 1*a*, is provided with front drive wheels 12 and rear casters or swivel wheels 14. Mounted on the rear of the machine is a pivotable squeegee assembly 16, the construction of which will be set forth hereinafter. As usual, the machine is provided with solution and recovery tanks for applying and picking up liquid from a floor surface which is cleaned and treated by counter-rotating brushes 18. The unit is battery operated for this purpose. The present machine is generally used in public and commercial buildings and for other large floor areas. However, it is known that on smooth floors, the usual type squeegee arrangement on a scrubbing machine will often drift to one side, causing the machine to leave water or other cleansing liquid on the floor. This serious drawback in a cleaning operation requires extra man hours for properly mopping up or otherwise drying the floor surface completely.

As seen in FIG. 8, the present squeegee 16 comprises a curvilinear squeegee arm 22 which is provided with outboard bumper wheels 24. In addition, the squeegee assembly is connected to an elongated squeegee bar 28 provided with a pivot 30. The squeegee assembly 22 may be assembled to the bar 28 and detached therefrom by means of threaded knobs 26, also as seen in FIG. 8.

The squeegee bar assembly 28 with pivot joint 30 is attached to the scrubbing machine by means of a pin 32 located at or near the geometric center of the automatic scrubbing machine. In addition, the bar is arranged to be placed at a height between 6 and 10 inches above the floor. It is important to note that the squeegee bar assembly 28 is provided with a carriage, referred to generally by the numeral 34, which has a pair of wheels 36 for maintaining the proper height of the squeegee bar from the floor.

Figure 4:
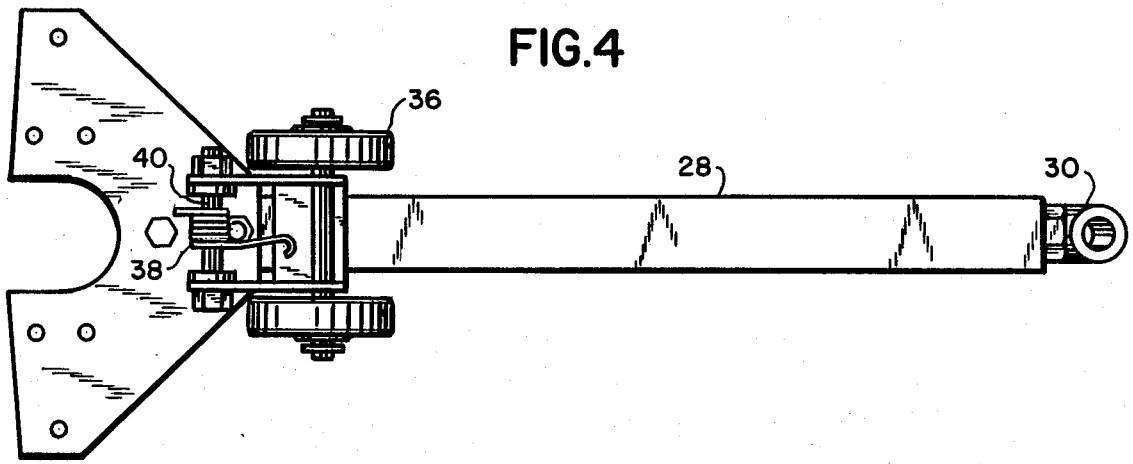
FIG. 4 is a bottom plan view thereof taken along the lines 4—4 of FIG. 5.
Figure 5:
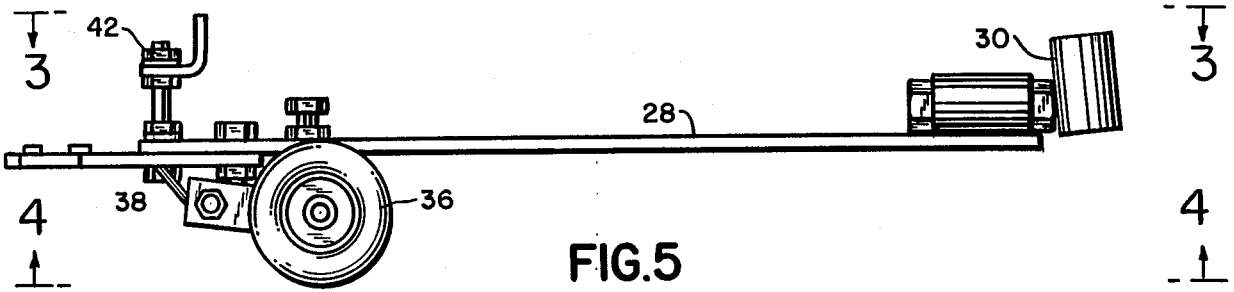

As particularly seen from the bottom plan view in FIG. 4, the carriage and the wheels thereon are biased in an upwardly direction by means of a coil spring 38 mounted about a fixed pin 40. Consequently, it should be apparent that the wheels 36, as well as the carriage assembly therefor, maintains a correct squeegee height for the proper liquid pick-up performance of the automatic scrubber machine. Furthermore, an adjusting screw 42 is provided for setting the proper height of the squeegee relative to the floor area being treated.

It should be apparent that because of the wheel assembly 34 and its construction and location, as well as the arrangement whereby pressure is applied constantly to the wheels on the carriage, the squeegee bar, and the squeegee which is connected thereto, is forced to follow the automatic scrubbing machine when it makes a turn while cleaning a floor. Consequently, the squeegee assembly will not drift off sideways or laterally when the machine is cleaning a smooth floor but will follow directly behind the machine at all times. Thus, the pivot joint allows the squeegee to go to the inside when a turn is made and also permits the squeegee to level itself laterally when encountering an uneven or wavy floor.

Figure 2:
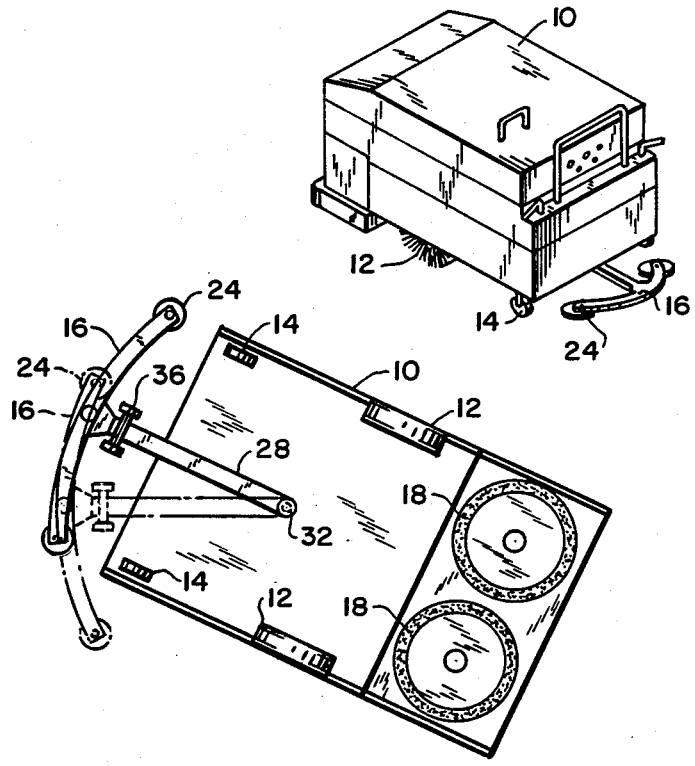
FIG. 2 is a bottom plan view showing the squeegee assembly together with the squeegee bar which is pivoted to the floor scrubbing machine, however the illustration in FIG. 2 also shows the position of the squeegee assembly in dotted lines when the machine is turned in the right hand direction.
Figure 3:
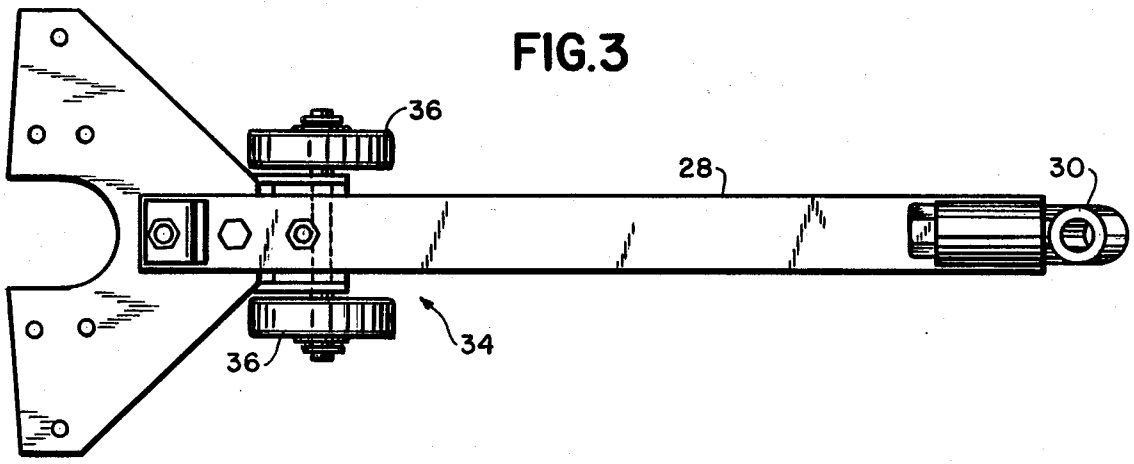
FIG. 3 is a top plan enlarged view of the squeegee bar assembly taken along the lines 3—3 of FIG. 5.

As seen in FIGS. 1 and 2, the squeegee bar assembly wheels 36 are closely spaced together and are mounted adjacent to the squeegee arm 22.

While the invention has been disclosed and described herein with reference to a single embodiment, it is apparent that other variations and modifications may be made which fall within the true spirit and scope of the invention as defined in the following claims.

We claim:

1. In an automatic scrubbing machine having a housing, cleaning liquid application and recovery tanks for applying said cleaning liquid to a floor, scrubbing brushes rotatably mounted on said housing for scrubbing said floor after said cleaning liquid has been applied, the improvement comprising: a mopping device in combination with and in tandem with said scrubbing machine including a squeegee assembly having an elongated bar provided with a pivot joint mounted at or near the geometric center of said housing and a wheeled carriage mounted on said bar adjacent to the center of said squeegee, whereby said squeegee assembly is constrained to follow the turning movements of said scrubbing machine without drifting laterally off to the side of the path of movement of said machine.

2. A scrubbing machine as claimed in claim 1 further comprising spring means biasing said wheeled carriage toward said floor hereby said squeegee is maintained at a substantially constant height above the floor.

3. A scrubbing machine as claimed in claim 2 wherein said constant height is chosen from the range of 6 inches to 10 inches.

4. A scrubbing machine as claimed in claim 2 further comprising adjustable means for changing the height of said carriage above the floor.

* * * * *